United States Patent [19]

Strongosky et al.

[11] Patent Number: 4,624,375

[45] Date of Patent: Nov. 25, 1986

[54] STOCKING DISPLAY DEVICE

[75] Inventors: John M. Strongosky, McGraw; David M. Freund, Syracuse, both of N.Y.

[73] Assignee: RPM Industries, Inc., Auburn, N.Y.

[21] Appl. No.: 689,462

[22] Filed: Jan. 7, 1985

[51] Int. Cl.[4] ..... A47F 5/12

[52] U.S. Cl. ..... 211/170; 223/75

[58] Field of Search ..... 211/170, 60.1, 100, 211/168, 169.1; 248/291; 403/93, 97, 84, 94; 223/60, 75, 112

[56] References Cited

U.S. PATENT DOCUMENTS

| | | | |
|---|---|---|---|
| 258,767 | 5/1882 | Kennard | 211/168 |
| 751,653 | 2/1904 | Katz | 223/75 |
| 1,404,270 | 1/1922 | Carr | 211/170 X |
| 2,617,564 | 11/1952 | Vogt et al. | 223/75 |
| 3,092,362 | 6/1963 | Walsh | 248/291 |
| 3,141,587 | 7/1964 | Albertson et al. | 223/75 |
| 3,570,728 | 3/1971 | DeWitt | 211/60.1 X |
| 3,602,466 | 8/1971 | Drowns | 248/514 |
| 4,289,243 | 9/1981 | Arbuzoff | 211/100 X |

*Primary Examiner*—Ramon S. Britts
*Assistant Examiner*—Sarah A. Lechok Eley
*Attorney, Agent, or Firm*—Bruns and Wall

[57] ABSTRACT

A stocking display device having a plurality of stocking forms mounted on a support in such a manner that each form can be moved into a number of different angular positions whereby a fan-like arrangement of the forms can be achieved. The support for the forms includes positive locking means to securely hold each stocking form in the angularly adjusted position into which it has been moved.

6 Claims, 6 Drawing Figures

STOCKING DISPLAY DEVICE

BACKGROUND OF THE INVENTION

This invention relates generally to merchandise display devices, and has particular reference to an adjustable stocking display device having a novel angular adjustment mechanism.

Stocking or hosiery display devices that employ a plurality of stocking forms have been in use for a number of years. These display devices are usually placed on a store counter top and stockings of different colors, sizes or textures are displayed on the forms which are usually fanned out at their upper ends to better show off the stockings.

The stocking forms in the prior art display devices are usually supported at their lower ends by a horizontal shaft the ends of which are received in a pair of end support members. The forms are pivotally mounted on the shaft so that a fan-like display arrangement can be achieved after which nuts or the like on the ends of the shaft are tightened to force the end support members closer together and thereby clamp the forms in the angular positions into which they have been moved. The forms are thus frictionally rather than positively held in position which means that if the display is jarred or bumped the stocking forms will usually be moved out of their carefully arranged display positions.

The applicants are not aware of any prior art patents that disclose display devices of the type disclosed in the present application. The assignee of the application is the owner of U.S. Pat. Nos. 3,567,084 and 3,570,728 which relate to stocking display devices but the patented devices are of a different type being constructed and used in a different manner.

SUMMARY OF THE INVENTION

The stocking display device of the present invention includes a plurality of stocking forms mounted on the same support in such a manner that each form can be moved into a number of different angular positions whereby a fan-like arrangement of the forms can be achieved. The support for the forms comprises a pair of end support members and a transverse, normally horizontal shaft extending between the support members in fixed relation thereto.

In accordance with the invention, positive locking means are provided to securely hold each stocking form in the angularly adjusted position into which it has been moved. The locking means include a disc-like angular positioning member for each stocking form which member is mounted on the support shaft in non-rotatable relation thereto. Each positioning member and its associated stocking form have coacting engagement means which permit the form to engage the positioning member in a selected one of a multiplicity of different angular positions, and the support for the forms includes means to releasably secure the stocking forms in the selected positions. In a preferred embodiment of the invention, the coacting engagement means consists of an arcuate scalloped flange on the stocking form and a scalloped periphery on the angular positioning member that mates with the arcuate flange as will be described in greater detail hereinafter.

DESCRIPTION OF THE PREFERRED EMBODIMENT

Figure 3:
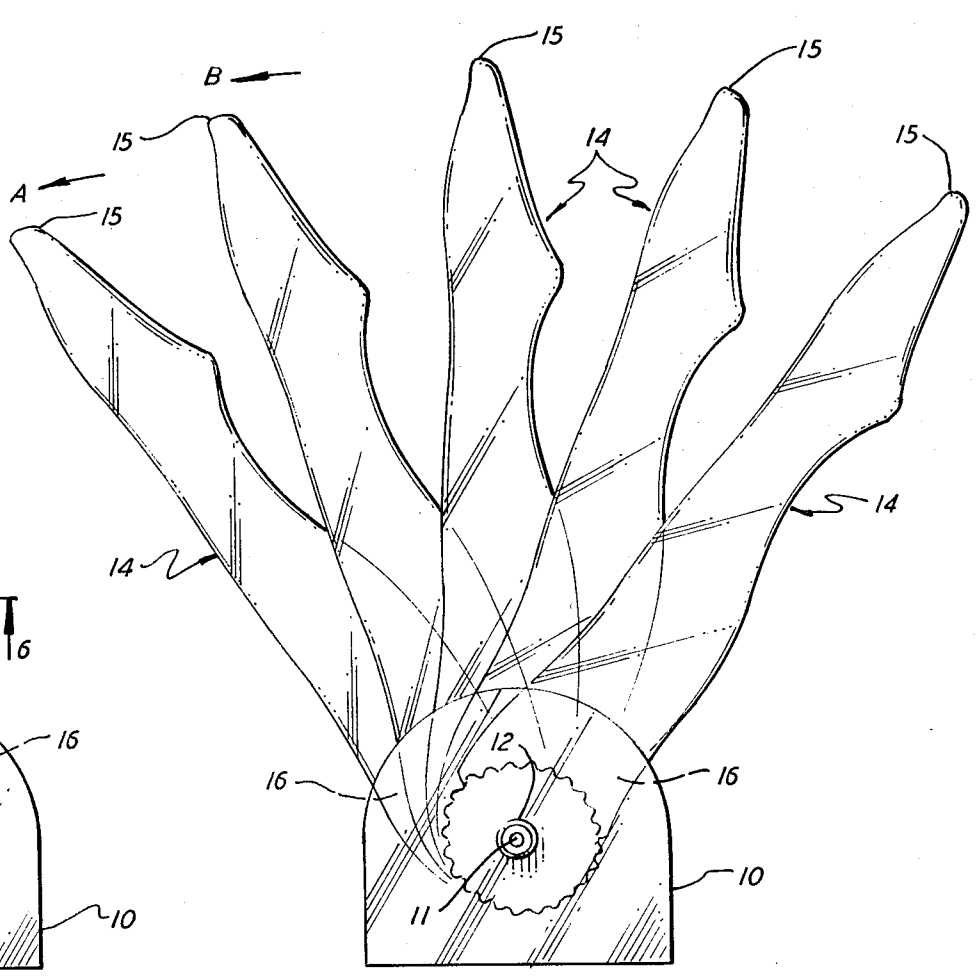
FIG. 3 is a side elevation of the device with the stocking forms shown in a fan-like display arrangement.

Having reference now to the drawings, the display device of the invention includes a pair of spaced end support members 10 that are connected by a shaft 11, the shaft having threaded ends which receive relatively large plastic nuts or fasteners 12. A plurality of stocking forms indicated generally at 14 are supported by the members 10 and shaft 11, there being five such forms in the illustrated embodiment although it will be apparent that a larger or smaller number can be employed. The stocking forms have a generally leg shaped profile as shown in FIGS. 2 and 3, and each form has a toe end 15 and a thigh end 16.

Figure 2:
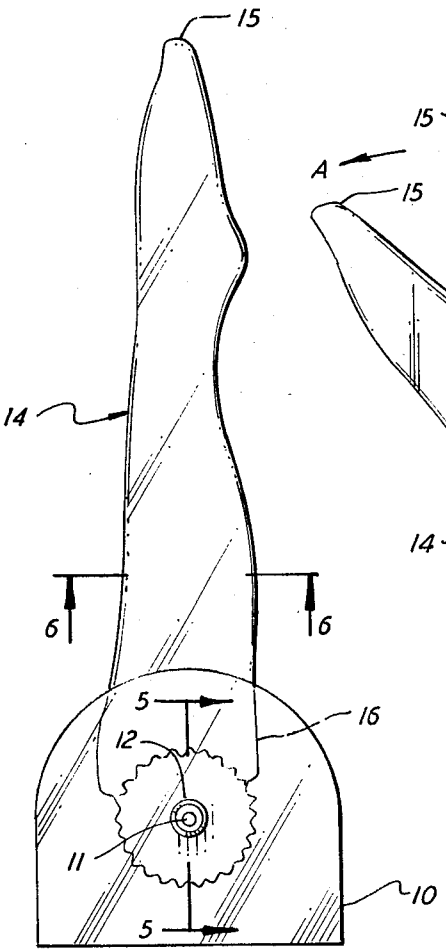
FIG. 2 is a side elevation of the device with the stocking forms shown in side by side alignment with one another.
Figure 1:
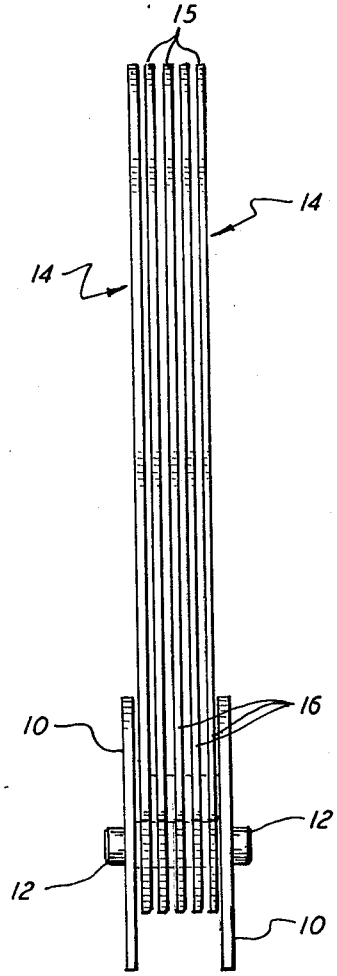
FIG. 1 is a front elevation of a stocking display device embodying the present invention.
Figure 4:
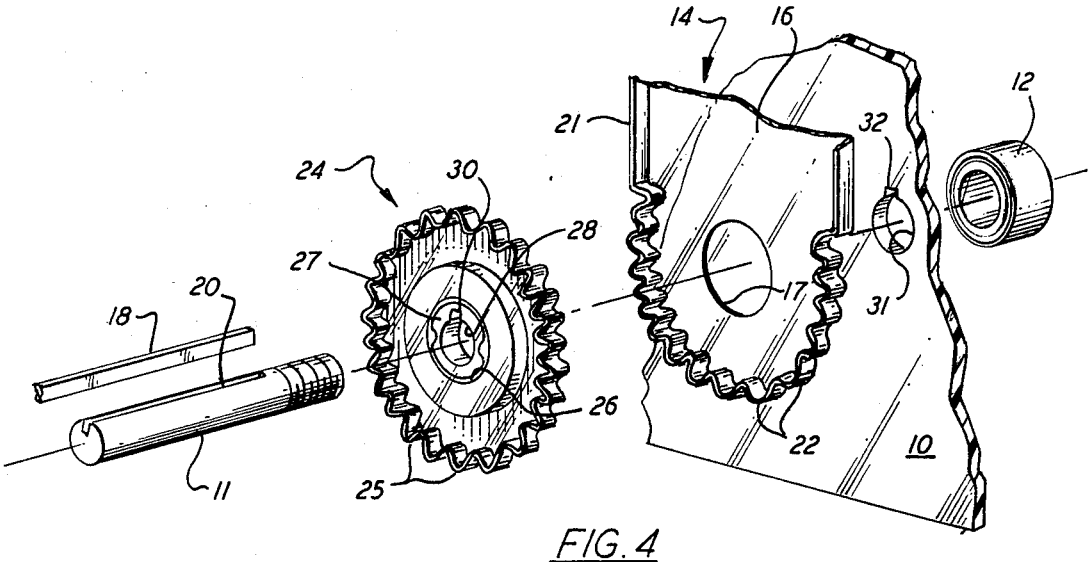
FIG. 4 is an exploded view on an enlarged scale of the positive angular adjustment means for each stocking form.

The thigh end 16 of each stocking form is substantially semi-circular, as best shown in FIGS. 2 and 4, and has a central hole 17 through which the shaft 11 passes. The hole diameter is significantly larger than that of the shaft and encircles the latter and a key 18, FIGS. 4 and 5, positioned in a keyway 20 in the shaft with a free fit. Each stocking form 14 is provided with a peripheral flange 21 that projects outwardly from the main plane of the form at substantially right angles thereto, and at the rounded thigh end of the form the flange is scalloped as best shown at 22 in FIG. 4.

Figure 5:
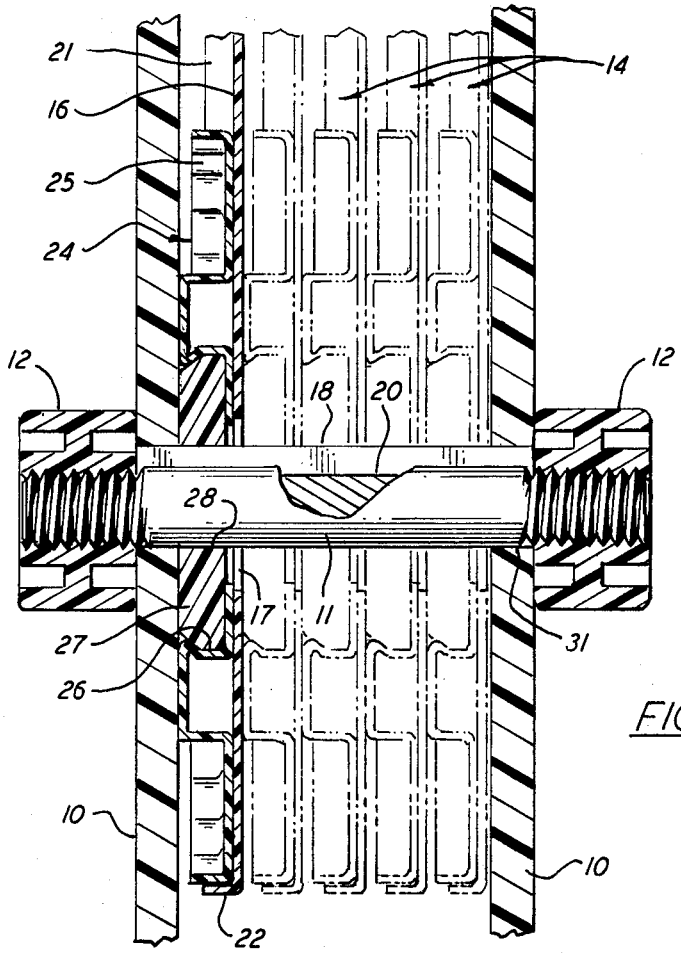
FIG. 5 is a greatly enlarged vertical sectional view through the stocking display device taken substantially on line 5—5 of FIG. 2.
Figure 6:
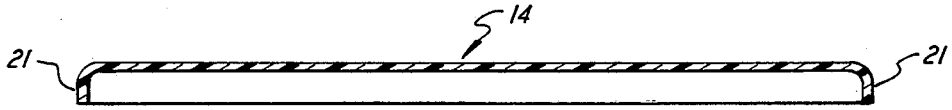
FIG. 6 is a greatly enlarged horizontal sectional view through a stocking form taken substantially on line 6—6 of FIG. 2.

In order to hold the stocking forms 14 in the angular positions desired, as for example in a fan-like display arrangement as shown in FIG. 3, each form coacts with a disc shaped positioning member generally indicated at 24, FIGS. 4 and 5. The positioning members 24 are formed with scalloped peripheral flanges 25 that respectively inter-engage or mate with the scalloped flanges 22 of the stocking forms.

Each positioning member 24 is formed with a circular, central recess or well 26, FIGS. 4 and 5, that is occupied by a reinforcing plug 27, the plug being permanently secured in the recess. The positioning member plug has a central hole 28 therethrough that is adapted to receive the shaft 11 with a close sliding fit. The central hole 28 includes a keyway 30 for the key 18 positioned in the shaft whereby relative rotation between the shaft and the positioning members is prevented. In this connection, it should be noted that the ends of shaft 11 pass with a close sliding fit through holes 31 in the end support members 10, FIGS. 4 and 5, and that these holes include keyways 32 whereby relative rotation between the shaft and the end support members is prevented.

To set up the above described display device so that the stocking forms 14 are locked in a desired display arrangement as shown, for example, in FIG. 3, the stocking forms and their respective positioning members 24 are initially loosely mounted on the shaft 11 in an alternating fashion. In the illustrated embodiment of the invention, the first positioning member would be positioned adjacent the left end of the shaft, then the first stocking form, then the second positioning member followed by the second stocking form, and so on proceeding from left to right. The left end of the shaft is then passed through an end support member 10 and a nut 12 is loosely threaded onto the outwardly projecting shaft end.

After the first positioning member 24 has been mounted on shaft 11 and pushed into engagement with the left end support member, the first stocking form, which can rotate freely on the shaft, is pivoted into the angular position desired for it, indicated at A in FIG. 3, and then is moved laterally to the left so that its scalloped flange 22 moves into engagement with the mating scalloped flange 25 on the positioning member. This operates to hold the stocking form in the desired position because the positioning member, as previously described, cannot rotate relative to the shaft 11. Thereafter, the second positioning member 24 is moved into engagement with the right side of the first stocking form and the second stocking form is pivoted into the angular position desired for it as indicated at B in FIG. 3, and then is moved laterally to engage its scalloped flange 22 with the mating flange 25 on the second positioning member.

The procedure described is followed for the third, fourth and fifth stocking forms after which the right hand end support member is mounted on the right end of the shaft and the end nuts 12 are tightened. Tightening the nuts causes the stocking forms and their positioning members to be clamped in side by side relation between the end support members whereby the forms are positively held in the positions selected for them and will remain so until the end nuts 12 are loosened and the forms disengaged from their respective positioning members.

From the foregoing description it will be apparent that the invention disclosed herein provides an improved stocking display having positive means for holding a plurality of stocking forms in a selected display arrangement. As will be understood by those familiar with the art, the invention may be embodied in other specific forms without departing from the spirit or essential characteristics thereof.

We claim:

1. An adjustable stocking display device comprising a plurality of stocking forms mounted on a common support such that each said form can be selectively moved into any of a number of different angular positions and said forms locked in such positions, said stocking forms having a generally leg-shaped profile with a toe end and a thigh end, said thigh end including means for mounting said stocking form on said support, said support including a common shaft passing through said common support and through the mounting means of each said stocking form; support means for supporting said shaft; a plurality of apertured disc-like positioning members each being disposed on said shaft against a respective one of said stocking forms, the disc-like positioning members and the stocking forms having mutually coacting interengaging structue to engage each other in non-rotational engagement; means on said shaft engaging corresponding means on said positioning members for preventing rotation of the latter on said shaft but permitting sliding of the positioning member relative thereto and permitting rotation of said stocking forms; and means on said shaft for releasably engaging said stocking forms, in their selected positions, against said positioning members.

2. A stocking display device as defined in claim 1 wherein said support meqans further includes a pair of spaced end support members, with said shaft extending transversely therebetween.

3. A stocking display device as defined in claim 1 wherein there are five said forms and five said positioning members.

4. A stocking display device as defined in claim 2 wherein said means for mounting each said stocking form on said support includes an opening of greater width than the diameter of said shaft and its associated rotation preventing means.

5. A stocking display device as defined in claim 1 wherein said coacting engagement structue on said positioning membes include scalloping on their periphery and said mounting means of said stocking forms includes a mating arcuate scalloped flange on said stocking form.

6. A stocking display device as defined in claim 1 wherein said positioning members are axially slidable on said shaft.

* * * * *